US011787218B1

(12) United States Patent
Kwiatkowski et al.

(10) Patent No.: US 11,787,218 B1
(45) Date of Patent: Oct. 17, 2023

(54) BOOK COVER EMBOSSING SYSTEM AND METHOD

(71) Applicant: LIGHTNING SOURCE LLC, LaVergne, TN (US)

(72) Inventors: John Kwiatkowski, LaVergne, TN (US); James Hartzell, LaVergne, TN (US); Kenneth M. McDonald, LaVergne, TN (US)

(73) Assignee: Lightning Source LLC, LaVergne, TN (US)

( * ) Notice: Subject to any disclaimer, the term of this patent is extended or adjusted under 35 U.S.C. 154(b) by 0 days.

(21) Appl. No.: 18/109,343

(22) Filed: Feb. 14, 2023

(51) Int. Cl.
*B42C 7/00* (2006.01)
*B42C 19/02* (2006.01)

(52) U.S. Cl.
CPC ..... *B42C 7/009* (2013.01); *B42C 19/02* (2013.01); *B42C 7/008* (2013.01)

(58) Field of Classification Search
CPC ..... B42C 7/009
USPC ..... 412/3, 17
See application file for complete search history.

(56) References Cited

U.S. PATENT DOCUMENTS

| | | | | |
|---|---|---|---|---|
| 3,306,631 | A * | 2/1967 | Bernson | B29C 65/48 412/17 |
| 5,413,446 | A * | 5/1995 | Rathert | B42C 7/00 412/17 |
| 6,193,458 | B1 | 2/2001 | Marsh | |
| 7,441,762 | B2 | 10/2008 | Kearns | |
| 7,448,650 | B2 * | 11/2008 | Hengsbach | B42D 3/00 283/64 |
| 9,067,453 | B2 | 6/2015 | Wiegand et al. | |
| 9,959,017 | B2 | 5/2018 | Mindrum | |
| 10,246,277 | B1 | 4/2019 | Kubiak et al. | |
| 10,421,627 | B2 | 9/2019 | Kubiak et al. | |
| 10,449,796 | B2 | 10/2019 | Dobrovolsky | |
| 2003/0148067 | A1 * | 8/2003 | Escobedo | B41J 11/70 156/219 |
| 2006/0028662 | A1 | 2/2006 | Dobrovolsky | |
| 2007/0036637 | A1 | 2/2007 | Hata et al. | |

(Continued)

FOREIGN PATENT DOCUMENTS

| | | | |
|---|---|---|---|
| EP | 0286772 | A2 * | 10/1987 |
| EP | 2269823 | A1 | 1/2011 |
| WO | WO9200854 | A1 * | 1/1992 |

*Primary Examiner* — Kyle R Grabowski
(74) *Attorney, Agent, or Firm* — Patterson Intellectual Property Law, PC

(57) ABSTRACT

The present disclosure relates to systems and methods for manufacturing embossed laminated hardcover book cases and embossed laminated hardcover books. The method of manufacturing an embossed laminated hardcover book case may comprise: receiving a book printing request from a user; printing a desired cover design on a cover sheet based at least in part on the received book printing request; applying a laminate sheet to the cover sheet using a laminating apparatus; embossing the laminate sheet using a textured roller of the laminating apparatus to define an embossed laminated cover sheet; providing a spine board and front and rear cover boards based at least in part on the received book printing request; and combining the spine board, the front and rear cover boards, and the embossed laminated cover sheet to define the embossed hardcover book case. Adding a book block converts the case into an embossed laminated hardcover book.

8 Claims, 7 Drawing Sheets

(56) References Cited

U.S. PATENT DOCUMENTS

| | | | | |
|---|---|---|---|---|
| 2009/0274536 | A1 | 11/2009 | Silberbauer | |
| 2010/0158639 | A1 | 6/2010 | Manico et al. | |
| 2012/0155701 | A1 | 6/2012 | Levine et al. | |
| 2017/0015093 | A1* | 1/2017 | Antonuzzo | B42C 7/00 |
| 2019/0047246 | A1* | 2/2019 | Bayer | B32B 27/34 |

* cited by examiner

BOOK COVER EMBOSSING SYSTEM AND METHOD

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present disclosure relates generally to hardcover book manufacturing. More particularly, the present disclosure pertains a digital process of manufacturing hardcover books.

BACKGROUND

Hardcover book manufacturing is a typically labor-intensive process that requires lots of manual preparation and handling, such as, for example, stocking materials, material gathering, pre-trimming of cloth material, foil stamping, labeling, and the like. As a result, the number of finished sizes offered to the market and customer are limited to a handful of pre-determined book sizes which must be kept in a manufacturers inventory. This creates a limitation in terms of size offerings for hard cover books due to having to manage and maintain inventory, as well as a need by manufacturers to reduce storage costs by limiting the amount of on-hand inventory, which is best accomplished by reducing the number of options. Further, because it is such a labor-intensive process, hardcover book manufacturing is typically only performed in large batch quantities and with similar sized books and book blocks manufactured at the same time.

Hardcover books may have differing cover materials. However, a popular favorite is cloth, also referred to herein as a cloth bound book cover. The current process of manufacturing a cloth bound book cover is by gluing a textured, pre-cut, clothlike material on to chip board (e.g., front and rear cover boards and a spine board). A cloth bound book cover is typical marked along the spine using a mechanical foil stamping machine. The mechanical foil stamping machine imprints one letter at a time with varying degrees of quality, legibility, and accuracy. Foil stamping is again a very labor-intensive process, requiring a worker to select title from batch in system, center the cover spine on the stamping table, and adjust stamping head pressure as needed. Foil stamping is also typically limited to alphanumeric characters and symbols.

BRIEF SUMMARY

In view of at least some of the above-referenced problems in conventional hardcover book manufacturing, an exemplary object of the present disclosure may be to provide a new and improved system and method for manufacturing hardcover books, namely, embossed laminated hardcover book covers and embossed laminated hardcover books by combining a book block with an embossed laminated hardcover book cover. An exemplary embossed laminated hardcover book cover, manufactured using the system and via the method, may feature a look and feel of traditional cloth bound hardcover books, but without the labor-intensive drawback thereof. An exemplary system, as disclosed herein, may feature laminating machine configured to laminate and emboss a digitally printed cover sheet such that the resultant embossed laminated cover sheet looks like and feels like a cloth cover without the associated drawbacks of stamping the cloth cover.

An exemplary method of manufacturing the embossed laminated hardcover book cover may feature a digital format whereby the cover color and text are printed on a digital press and the cover is finished using a laminating machine, having a textured roller configured to create the effect and look of a traditional cloth bound cover.

Further, the exemplary system and method enable a true one-off print model, not bound by the financial and labor-intensive drawbacks of traditional hardcover book manufacturing.

The exemplary system and method further optimize and automate the process of manufacturing hardcover books and components by eliminating size and variability constraints on the finished product.

In a particular embodiment, an exemplary method of manufacturing an embossed hardcover book case as disclosed herein may include: (a) receiving a book printing request from a user; (b) printing a desired cover design on a cover sheet based at least in part on the received book printing request; (c) applying a laminate sheet to the cover sheet using a laminating apparatus; (d) embossing the laminate sheet using a textured roller of the laminating apparatus to define an embossed laminated cover sheet; (e) providing a spine board and front and rear cover boards based at least in part on the received book printing request; and (I) combining the spine board, the front and rear cover boards, and the embossed laminated cover sheet to define the embossed hardcover book case.

In an exemplary aspect according to the above-referenced embodiment, the textured roller may be used to apply the laminate sheet to the cover sheet in step (c).

In another exemplary aspect according to the above-referenced embodiment, steps (c) and (d) may be performed simultaneously.

In another exemplary aspect according to the above-referenced embodiment, step (e) of the method may further include: trimming the front and rear cover boards using a board trimming apparatus based at least in part on the received book printing request; and trimming the spine board using the board trimming apparatus based at least in part on the received book printing request.

In another exemplary aspect according to the above-referenced embodiment, step (d) of the method may further include heating the textured roller prior to embossing the laminate sheet.

In another exemplary aspect according to the above-referenced embodiment, the method may further include, after step (d), trimming the embossed laminated cover sheet using a cover trimming apparatus based at least in part on the received book printing request.

In another exemplary aspect according to the above-referenced embodiment, the desired cover design may include a textured filter for enhancing the embossed laminated cover sheet.

In another exemplary aspect according to the above-referenced embodiment, step (a) of the method may further include selecting a textured filter to be applied to the desired cover design.

In another exemplary aspect according to the above-referenced embodiment, the cover sheet may be uncoated 100 # white text paper.

In another exemplary aspect according to the above-referenced embodiment, the laminate sheet may be 1.4 mil matte film laminate.

In another exemplary aspect according to the above-referenced embodiment, step (f) of the method may further include feeding the spine board, the front and rear cover boards, and the embossed laminated cover sheet into a case making apparatus configured to produce the embossed hardcover book case.

In a particular embodiment, an exemplary system for manufacturing an embossed hardcover book case configured to receive a book block as disclosed herein may include a printing apparatus, a laminating apparatus, a case making apparatus, and a control system. The printing apparatus may be configured to print a desired cover design on a cover sheet. The laminating apparatus may be configured to apply a laminate sheet to the cover sheet and emboss the laminate sheet using a textured roller of the laminating apparatus to define an embossed laminated cover sheet. The case making apparatus may be configured to combine a spine board, front and rear cover boards, and the embossed laminated cover sheet to define the embossed hardcover book case. The control system may be functionally linked to each of the printing apparatus, the laminating apparatus, and the case making apparatus. The control system may be configured to: receive a book printing request from a user; and control each of the printing apparatus, the laminating apparatus, and the case making apparatus based at least in part on the book printing request.

In an exemplary aspect according to the above-referenced embodiment, the textured roller may be used to apply the laminate sheet to the cover sheet.

In another exemplary aspect according to the above-referenced embodiment, the control system may be configured to control a heating element of the textured roller of the laminating apparatus.

In another exemplary aspect according to the above-referenced embodiment, the system may further include a board trimming apparatus configured to trim each of the spine board and the front and rear cover boards.

In another exemplary aspect according to the above-referenced embodiment, the control system may be configured to control the board trimming apparatus based at least in part on the book printing request.

In another exemplary aspect according to the above-referenced embodiment, the system may further include a cover trimming apparatus configured to trim the embossed laminated cover sheet.

In another exemplary aspect according to the above-referenced embodiment, the control system may be configured to control the cover trimming apparatus based at least in part on the received book printing request.

In another exemplary aspect according to the above-referenced embodiment, the control system may be configured to apply a textured digital filter to the desired cover design prior to printing.

In another exemplary aspect according to the above-referenced embodiment, the textured digital filter may be selected by the user and included as part of the book printing request.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
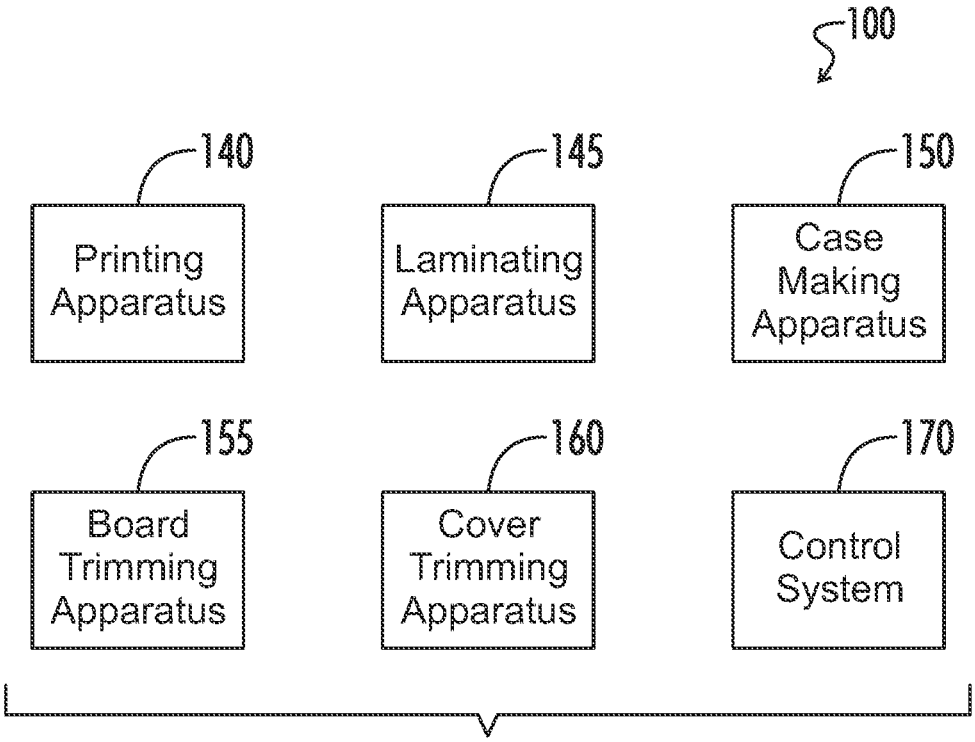
FIG. 1 is a block diagram of a system for manufacturing an embossed hardcover book case in accordance with the present disclosure.
Figure 2:
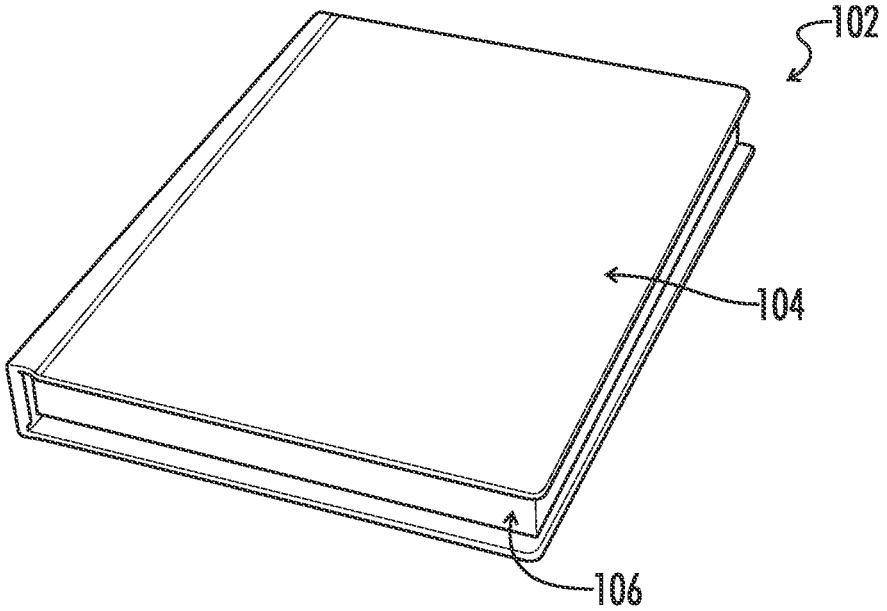
FIG. 2 is a perspective view of an embossed hardcover book in accordance with the present disclosure.
Figure 3:
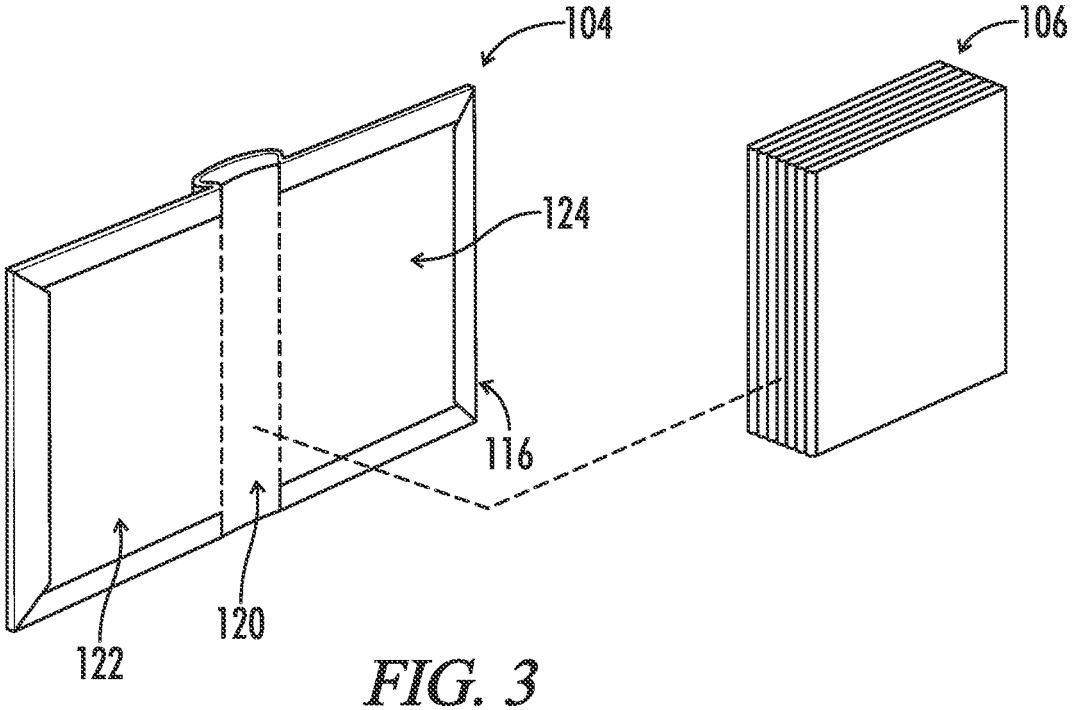
FIG. 3 is a partially exploded view of the embossed hardcover book of FIG. 2 in accordance with the present disclosure.
Figure 4A:
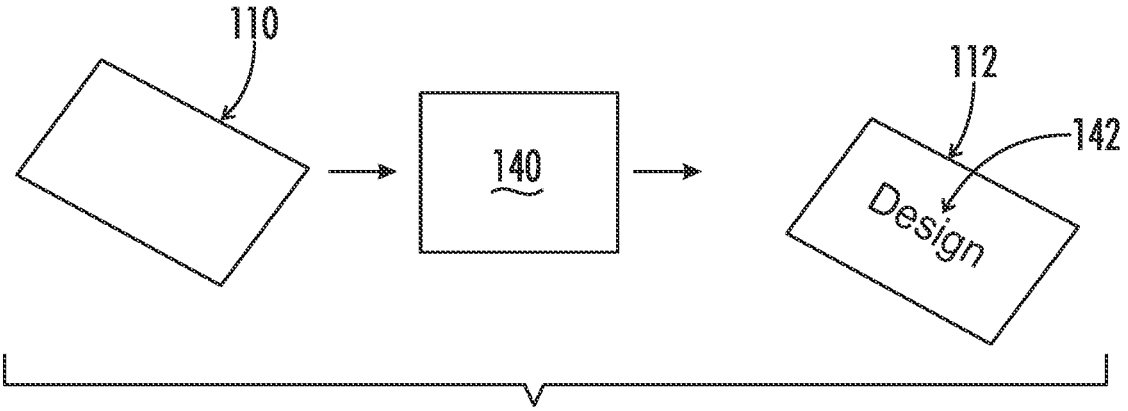
FIG. 4A is a block diagram of an embodiment of a printing apparatus of the system of FIG. 1 in combination with a cover sheet in accordance with the present disclosure.

Referring to FIG. 1, a system 100 for manufacturing an embossed laminated hardcover book case 104 (shown in FIGS. 2 and 3). As illustrated in FIGS. 2 and 3, the embossed laminated hardcover book case 104 may be configured to receive a book block 106 having dimensions (e.g., height, width, depth). The combined embossed laminated hardcover book case 104 and the book block 106 may define an embossed laminated hardcover book 102. As such, the system 100 may further be configured for manufacturing the embossed laminated hardcover book 102. The embossed laminated hardcover book case 104 may be configured to mimic the look and feel of typical cloth cover's for hardcover books without the problems associated with manufacturing cloth bound hardcover books Referring back to FIG. 1, the system 100 may include a printing apparatus 140, laminating apparatus 145, a case making apparatus 150, and a control system 170. As illustrated in FIG. 4A, the printing apparatus 140 may be configured to print a desired cover design 142 onto a cover sheet 110 to define a printed cover sheet 112. The cover sheet 110 may be uncoated #100 white text paper, any other weight or color of paper, or the like.

Figure 5A:
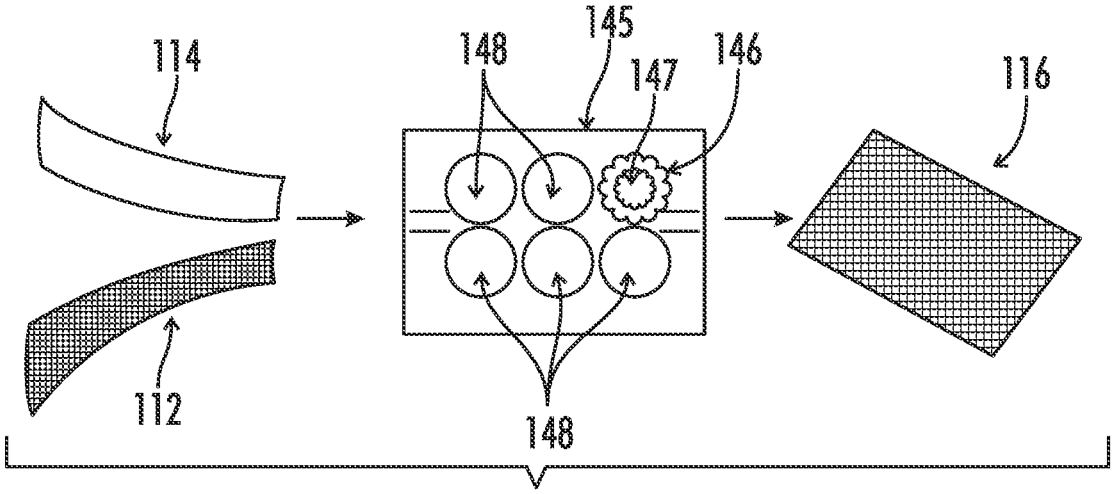
FIG. 5A is a block diagram of an embodiment of a laminating apparatus of the system of FIG. 1 in combination with a cover sheet and a laminate sheet in accordance with the present disclosure.
Figure 5B:
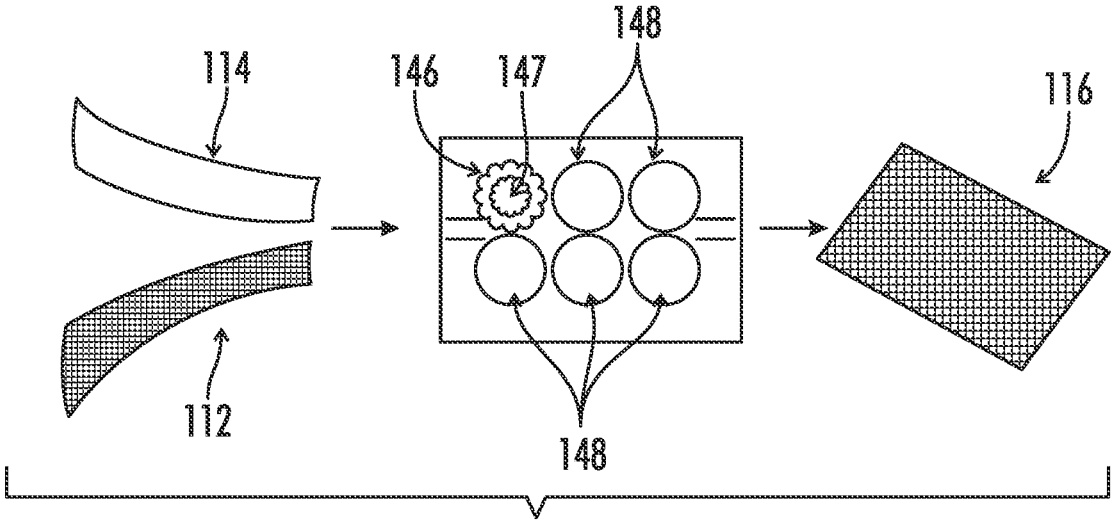
FIG. 5B is a block diagram of another embodiment of a laminating apparatus of the system of FIG. 1 in combination with a cover sheet and a laminate sheet in accordance with the present disclosure.

As illustrated in FIGS. 5A and 5B, the laminating apparatus 145 may be configured to apply a laminate sheet 114 to the cover sheet 110 post printing (e.g., to the printed cover sheet 112). The laminate sheet 114 may be 1.4 mil matte film laminate or the like. The laminating apparatus 145 may also be configured to emboss the laminate sheet 114 using a textured roller 146 of the laminating apparatus 145 to define an embossed laminated cover sheet 116. The textured roller 146 may texturize the laminate sheet 114 as it is applied to the printed cover sheet 112 such that the embossed laminated cover sheet 116 mimics the linen feel of cloth covers, or any other optional cover material such as, for example, leather, wood, or the like. The textured roller 146 may, for example, be one of a plurality of rollers 148 of the laminating apparatus 145. In certain optional embodiments, as illustrated in FIG. 5B, the textured roller 146 may be used to apply the laminate sheet 114 to the printed cover sheet 112. In other embodiments, as illustrated in FIG. 5A, the textured roller 146 may emboss laminate sheet 114 after being applied to the printed cover sheet 112 by other ones of the plurality of rollers 148. At least the textured roller 146 may include a heating element 147 positioned therein.

Figure 4B:
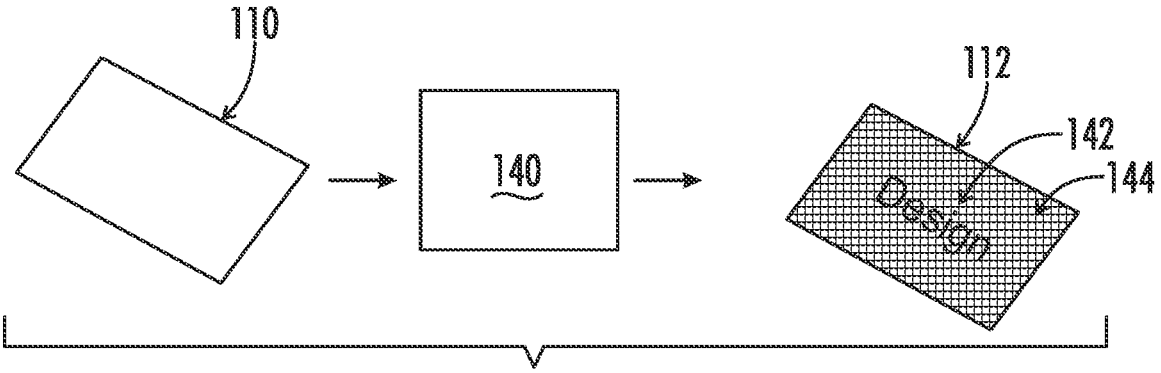
FIG. 4B is a block diagram of another embodiment of a printing apparatus of the system of FIG. 1 in combination with the cover sheet in accordance with the present disclosure.

In certain optional embodiments, as illustrated in FIG. 4B, the desired cover design 142 may include a textured filter 144 applied to the desired cover design 142. The textured filter 144 may be configured to enhance the look (or realism) of the embossed laminated cover sheet 116 such that, for example, the embossed laminated cover sheet 116 even more so resembles or mimics the look of cloth, leather, wood, or the like. The textured filter 144 may also be referred to herein as a textured digital filter 144.

Figure 6:
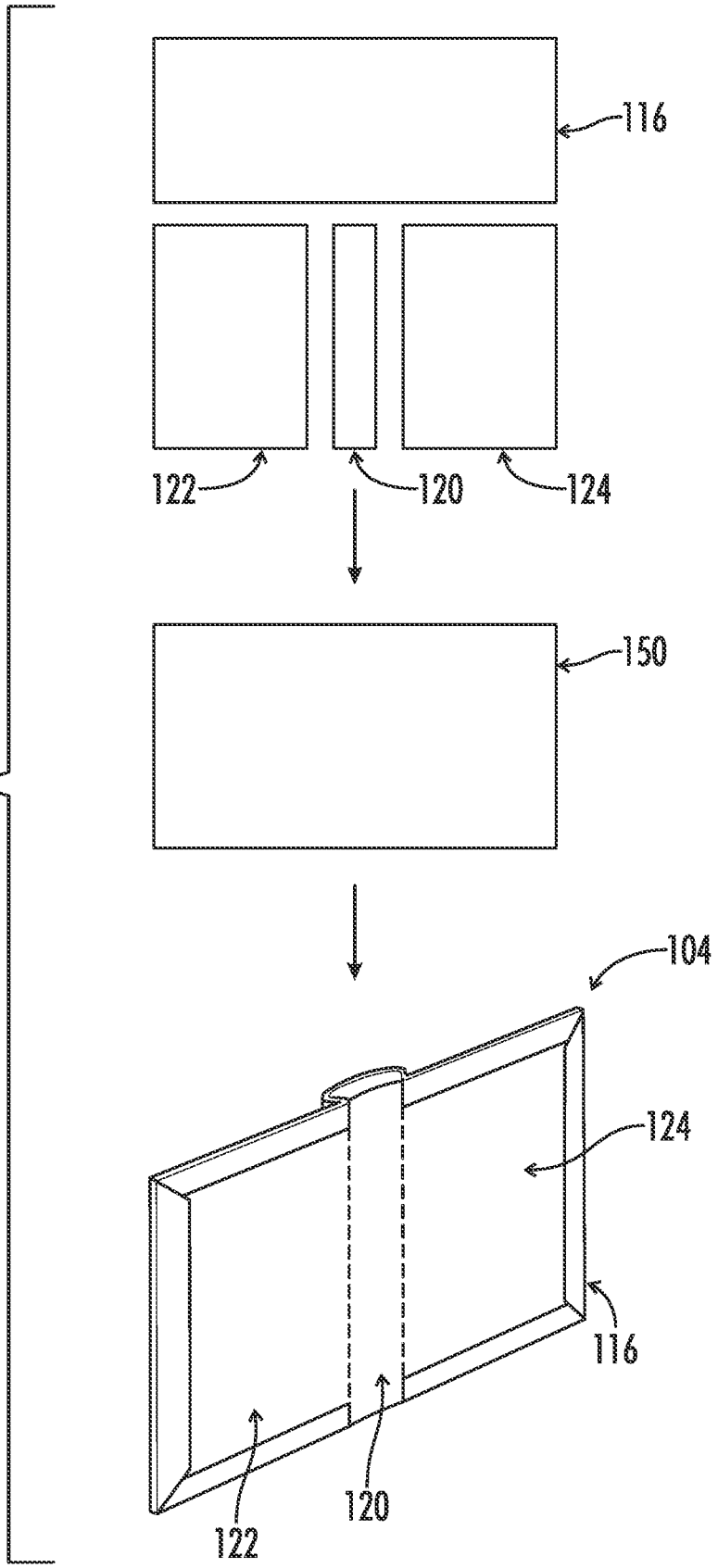
FIG. 6 is a block diagram of a case making apparatus of the system of FIG. 1 in combination with an embossed laminated cover sheet, a spine board, and front and rear cover boards in accordance with the present disclosure.

As illustrated in FIG. 6, the case making apparatus 150 may be configured to a spine board 120, a front cover board 122, a rear cover board 124, and the embossed laminated cover sheet 116 to create the embossed laminated hardcover book case 104. The case making apparatus 150 may accomplish this task using robotic arms, vacuum engagement, adhesives, and/or the like. In certain optional embodiments, the case making apparatus 150 may, for example, be a GP2 Technologies, Inc. SC-3 machine, or the like.

As further illustrated in FIG. 1, the system 100 may further include a board trimming apparatus 155 and a cover trimming apparatus 160. The board trimming apparatus 155 may be configured to cut each of the spine board 120, the front cover board 122, and the rear cover board 124, for example, from a large sheet of board material (not shown) prior to being combined with the embossed laminated cover sheet 116 in the case making apparatus 150. The board trimming apparatus 155 may eliminate the need to have inventories of pre-cut, pre-sized spine boards, and front and rear cover boards. In certain optional embodiments, the board trimming apparatus 155 may, for example, be a GP2 Technologies, Inc. BT-1 machine, or the like. In other optional embodiments, the cover trimming apparatus 160 may, for example, be a GP2 Technologies, Inc. CT-1 machine, or the like.

Similarly, the cover trimming apparatus 160 may be configured to cut the embossed laminated cover sheet 116 prior to being combined with each of the spine board 120, the front cover board 122, and the rear cover board 124 in the case making apparatus 150.

Figure 7:
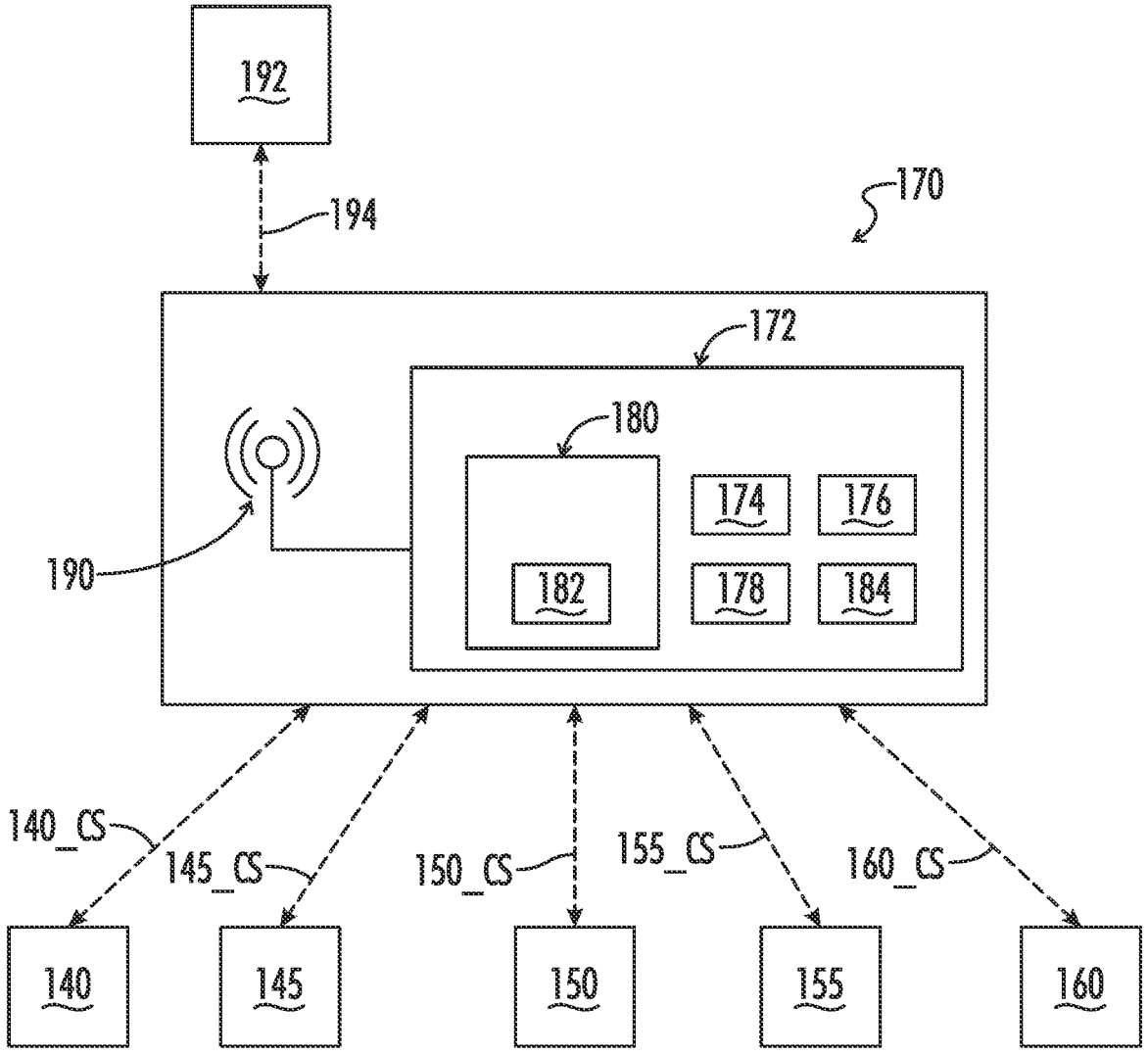
FIG. 7 is a block diagram of an exemplary control system of the system of FIG. 1 in accordance with the present disclosure.

Referring to FIG. 7, an exemplary control system 170 for the system 100 may include a single controller 172 or discrete controllers for each of the printing apparatus 140, the laminating apparatus 145, the case making apparatus 150, and, optionally, the board trimming apparatus 155 and the cover trimming apparatus 160.

The controller 172 of the system 100 may include a processor 174, a computer readable memory medium 176, a database 178, and an input/output module or control panel 180 having a display 182.

The terms "controller," "control circuit" or "control unit" may be used herein to refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general-purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The term "computer-readable memory medium" as used herein may refer to any non-transitory medium 176 alone or as one of a plurality of non-transitory memory media 176 within which is embodied in a computer program product 184 that includes processor-executable software, instructions or program modules which upon execution may provide data or otherwise cause a computer system to implement subject matter or otherwise operate in a specific manner as further defined herein. It may further be understood that more than one type of memory media may be used in combination to conduct processor-executable software, instructions or program modules from a first memory medium upon which the software, instructions or program modules initially reside to a processor for execution.

"Memory media" as generally used herein may further include without limitation transmission media and/or storage media. "Storage media" may refer in an equivalent manner to volatile and non-volatile, removable and non-removable media, including at least dynamic memory, application specific integrated circuits (ASIC), chip memory devices, optical or magnetic disk memory devices, flash memory devices, or any other medium which may be used to stored data in a processor-accessible manner, and may unless otherwise stated either reside on a single computing platform or be distributed across a plurality of such platforms. "Transmission media" may include any tangible media effective to permit processor-executable software, instructions or program modules residing on the media to be read and executed by a processor, including without limitation wire, cable, fiber-optic and wireless media such as is known in the art.

The term "processor" as used herein may refer to at least general-purpose or specific-purpose processing devices and/or logic as may be understood by one of skill in the art, including but not limited to single- or multithreading processors, central processors, parent processors, graphical processors, media processors, and the like.

The control system 170 may further include a wireless transceiver 190 coupled to the controller 172. The wireless transceiver 190 may be configured to at least receive data 194 from an external device 192, such as, for example, a user's personal computer, smartphone, or the like. The data 194 may, for example, be a book printing request from a user. The data 194 may also be referred to herein as a book printing request 194. The wireless transceiver 190 may utilize radio frequency (RF), Bluetooth, Bluetooth Low Energy, WiFi, cellular, pulse light, or the like.

Based upon various operational parameters which may be defined by the computer programming product 184 of the controller 172, the controller system 170 may generate various control signals (CS) which may be communicated to each of the printing apparatus 140 (schematically illustrated via the dashed communication line 140_CS), the laminating apparatus 145 (schematically illustrated via the dashed communication line 145_CS), the case making apparatus 150 (schematically illustrated via the dashed communication line 150_CS), optionally the board trimming apparatus 155 (schematically illustrated via the dashed communication line 155_CS), and optionally the cover trimming apparatus 160 (schematically illustrated via the dashed communication line 160_CS). The control system 170 may be configured to control each of the printing apparatus 140, the laminating apparatus 145, the case making apparatus 150, optionally the board trimming apparatus 155, and the optionally cover trimming apparatus 160 based upon the book printing request 194 (e.g., from the user). The book printing request 194 may dictate the dimensions of the book block 106 which may affect the size of each of the cover sheet 110, the spine board 120, and the front and rear cover boards 122, 124.

In certain optional embodiments, each of the printing apparatus 140, the laminating apparatus 145, the case making apparatus 150, optionally the board trimming apparatus 155, and optionally the cover trimming apparatus 160 may be coupled together using a conveyor system (not shown) which may also be controlled by the control system 170.

Figure 8:
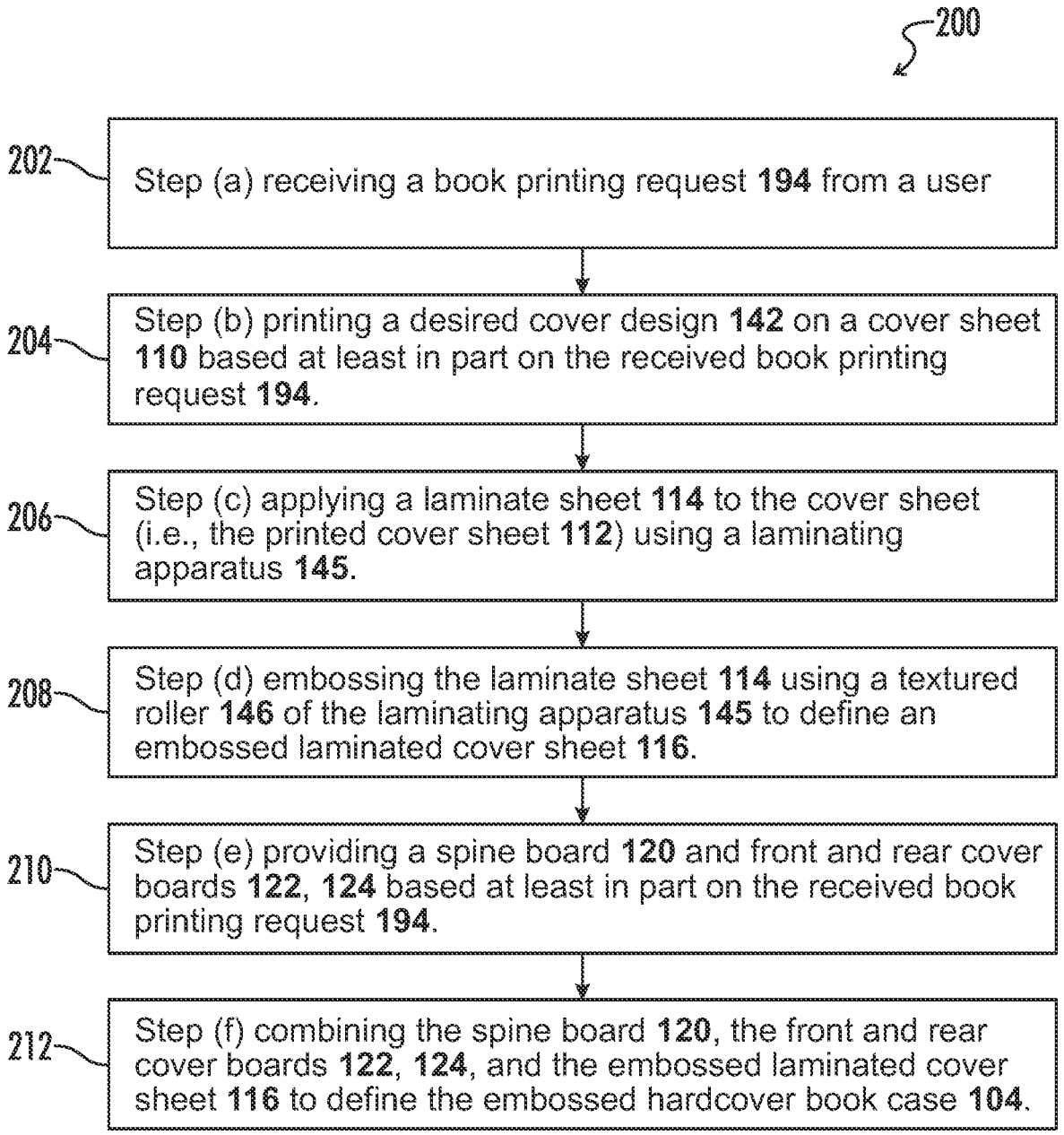
FIG. 8 is a flowchart of a method of manufacturing an embossed hardcover book case utilizing the system of FIG. 1 in accordance with the present disclosure.

Referring to FIG. 8, with further illustrative reference back to FIGS. 1-7, an embodiment of a method 200 may now be described which is exemplary but not limiting on the scope the present disclosure unless otherwise specifically noted. One of skill in the art may appreciate that alternative embodiments may include fewer or additional steps, and that certain disclosed steps may for example be performed in different chronological order or simultaneously. Unless otherwise specifically noted, operations, steps, functions, processes, and the like as disclosed in association with the method 200 may be executed or directed by a single computing device, or via multiple computing devices in operable communication via a communications network. Exemplary such computing devices may include onboard controllers or machine control systems, remote (e.g., cloud) servers, mobile user devices, and the like. Finally, one of skill in the art will understand and appreciate that the method 200 may be executed by the system 100.

The method 200 may be directed to manufacturing an embossed laminated hardcover book case 104. The method 200 may include step (a) receiving 202 a book printing request 194 from a user. The method 200 may further include step (b) printing 204 a desired cover design 142 on a cover sheet 110 based at least in part on the received book printing request 194. The method 200 may further include step (c) applying 206 a laminate sheet 114 to the cover sheet (i.e., the printed cover sheet 112) using a laminating apparatus 145. The method 200 may further include step (d) embossing 208 the laminate sheet 114 using a textured roller 146 of the laminating apparatus 145 to define an embossed laminated cover sheet 116. The method 200 may further include step (e) providing 210 a spine board 120 and front and rear cover boards 122, 124 based at least in part on the received book printing request 194. The method 200 may further include step (f) combining 212 the spine board 120, the front and rear cover boards 122, 124, and the embossed laminated cover sheet 116 to define the embossed laminated hardcover book case 104.

In certain optional embodiments, the textured roller 146 may be used to apply the laminate sheet 114 to the cover sheet 110 in step (c). As such, steps (c) and (d) may be performed simultaneously.

In other optional embodiments, step (e) of the method 200 may further include: trimming the front and rear cover boards 122, 124 using a board trimming apparatus 155 based at least in part on the received book printing request 194; and trimming the spine board 120 using the board trimming apparatus 155 based at least in part on the received book printing request 194.

In further optional embodiments, step (d) of the method 200 may further include heating the textured roller 146 prior to embossing the laminate sheet 114.

In certain optional embodiments, the method 200 may further comprise, after step (d), trimming the embossed laminated cover sheet 116 using a cover trimming apparatus 160 based at least in part on the received book printing request 194.

In other optional embodiments, the desired cover design may include a textured filter 144 for enhancing the embossed laminated cover sheet 116.

In further optional embodiments, step (f) of the method 200 may further include feeding the spine board 120, the front and rear cover boards 122, 124, and the embossed laminated cover sheet 116 into a case making apparatus 150 configured to produce the embossed laminated hardcover book case 104.

In certain optional embodiments, the method 200 may further be directed to manufacturing an embossed laminated hardcover book 102 when the following two method steps are included, namely: preparing a book block 106 based at least in part on the received book printing request 194; and combining the embossed laminated hardcover book case 104 with the book block 106 to define the embossed laminated hardcover book 102.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

The previous detailed description has been provided for the purposes of illustration and description. Thus, although there have been described particular embodiments of a new and useful invention, it is not intended that such references be construed as limitations upon the scope of this disclosure except as set forth in the following claims.

What is claimed is:

1. A method of manufacturing an embossed hardcover book case having a simulated material texture, the method comprising:

(a) receiving a book printing request from a user;

(b) digitally printing a desired cover design on a cover sheet, wherein the desired cover design includes a textured filter corresponding to the simulated material and selected in the received book printing request;

(c) heating a textured roller of a laminating apparatus;

(d) simultaneously applying a laminate sheet and embossing the laminate sheet using the textured roller of the laminating apparatus to define an embossed laminated cover sheet;

(e) trimming the embossed laminated cover sheet using a cover trimming apparatus based at least in part on the received book printing request;

(f) providing a spine board and front and rear cover boards based at least in part on the received book printing request; and (g) combining the spine board, the front and rear cover boards, and the embossed laminated cover sheet to define the embossed hardcover book case.

2. The method of claim 1, wherein step (e) further comprises:

trimming the front and rear cover boards using a board trimming apparatus based at least in part on the received book printing request; and trimming the spine board using the board trimming apparatus based at least in part on the received book printing request.

3. The method of claim 1, wherein:

the cover sheet is uncoated 100 # white text paper.

4. The method of claim 1, wherein:

the laminate sheet is 1.4 mil matte film laminate.

5. The method of claim 1, wherein step (g) further comprises:

feeding the spine board, the front and rear cover boards, and the embossed laminated cover sheet into a case making apparatus configured to produce the embossed hardcover book case.

6. A system for manufacturing an embossed hardcover book case configured to receive a book block, the system comprising:

one or more controller configured, responsive to parameters provided in a book printing request, to generate control signals to each of a printing apparatus configured in response to the control signals to print a desired cover design on a cover sheet, wherein a textured digital filter is provided in the book printing request and applied to the desired cover design prior to printing;

a laminating apparatus configured in response to the control signals to simultaneously apply a laminate sheet to the cover sheet and emboss the laminate sheet using a textured roller of the laminating apparatus to define an embossed laminated cover sheet, wherein a heating element is utilized to heat the textured roller prior to the application and embossing of the laminate sheet;

a case making apparatus configured in response to the control signals to combine a spine board, front and rear cover boards, and the embossed laminated cover sheet to define the embossed hardcover book case; and a board trimming apparatus configured in response to the control signals to trim each of the spine board and the front and rear cover boards.

7. The system of claim 6, further comprising:

a cover trimming apparatus configured to trim the embossed laminated cover sheet.

8. The system of claim 7, wherein:

the control system is configured to control the cover trimming apparatus based at least in part on the received book printing request.

* * * * *